US008458968B2

(12) United States Patent
Shoshan

(10) Patent No.: US 8,458,968 B2
(45) Date of Patent: Jun. 11, 2013

(54) TRACK ASSEMBLY HAVING MULTIPLE PANELS WITH DRAIN METHOD AND DEVICE

(75) Inventor: Eyal Shoshan, Las Vegas, NV (US)

(73) Assignee: Panda Windows & Doors, Inc., Las Vegas, NV (US)

( * ) Notice: Subject to any disclaimer, the term of this patent is extended or adjusted under 35 U.S.C. 154(b) by 29 days.

(21) Appl. No.: 12/840,547

(22) Filed: Jul. 21, 2010

(65) Prior Publication Data

US 2012/0017515 A1 Jan. 26, 2012

(51) Int. Cl.
*E04B 7/14* (2006.01)

(52) U.S. Cl.
USPC ..... 52/209; 52/204.7; 52/302.6; 52/302.7

(58) Field of Classification Search
USPC ..... 52/209, 204.7, 302.3, 302.6, 302.7, 52/302.1, 204.52, 220.7, 220.8
See application file for complete search history.

(56) References Cited

U.S. PATENT DOCUMENTS

| | | | | |
|---|---|---|---|---|
| 2,333,374 | A * | 11/1943 | Guthrie | 261/97 |
| 2,791,011 | A * | 5/1957 | Heep | 52/209 |
| 4,691,487 | A * | 9/1987 | Kessler | 52/209 |
| 6,098,355 | A * | 8/2000 | Li | 52/212 |
| 6,789,359 | B2 * | 9/2004 | Bauman et al. | 49/471 |
| 7,134,245 | B2 * | 11/2006 | Burton | 52/209 |
| 7,574,829 | B1 * | 8/2009 | Prager | 49/408 |

* cited by examiner

*Primary Examiner* — William Gilbert
*Assistant Examiner* — Gisele Ford
(74) *Attorney, Agent, or Firm* — Weiss & Moy, P.C.; Jeffrey D. Moy

(57) ABSTRACT

A window or door assembly and/or system having a drain method and device that is less invasive than previous implementations. The assembly can include slidable window or door panels and an upright support allowing translational movement of the panels. Distal thereto, a weeping upright is provided. The upright support and the weeping upright can form a channel therebetween where the liquid is collected, wherein the channel in one embodiment is L-shaped. To remove liquid from the channel, an accumulator that is perpendicular to the channel can receive the fluid through an opening. Liquid can also be removed through a drainage opening within the upright support or weeping upright. An aperture along with a connector along a bottom portion of the channel can also be used to remove the liquid within the channel.

18 Claims, 10 Drawing Sheets

TRACK ASSEMBLY HAVING MULTIPLE PANELS WITH DRAIN METHOD AND DEVICE

TECHNICAL FIELD

The application generally relates to sliding door or window assemblies, and more particularly, to a draining frame for removing moisture or other liquid that may accumulate within a sliding door or window assembly, and a system including such assembly and drainage frame.

BACKGROUND OF THE INVENTION

The ability to drain rain water or other condensation from window sills and patio doors is desired for some installations. Sliding closure assemblies may require some form of drainage to prevent rain water and condensation from entering the interior of a building around the movable panes. In the past, positioned drain holes throughout the assemblies have been provided to allow water to escape as it forms.

While numerous drainage systems have been designed to solve this problem, most such drainage systems require a hollow sill construction. These systems are not adapted to the drainage of horizontally sliding closure assemblies such as patio doors which are normally constructed with a solid sill for strength and durability. The infiltration of wind driven water may be a particular problem with patio doors for some installations because it is desirable to have a sill profile that is as low and unobtrusive as possible to facilitate passage through the door with wheelchairs and the like.

Many systems have been designed for directional drainage of water and moisture. Nevertheless, these systems have been invasive requiring intensive ground preparations. One such drainage system utilizes a collection pan mounted under a channel where the liquid is collected. The pan collects the liquid from the channel through an aperture, usually by way of gravity. Because of its lower position, the collection pan requires additional trenching work so that the collection pan can be properly fitted.

The present application provides a frame drain method and system for horizontally sliding closure assemblies such as patio doors or windows which permits the drainage of water from the interior of the closure. A system consisting of such frame and assembly allows minimally invasive techniques requiring less trenching or other work performed.

BRIEF DESCRIPTION OF THE PREFERRED EMBODIMENTS

In accordance with an embodiment of the present invention, an assembly is disclosed. The assembly comprises, in combination: an upright support allowing translational movement of at least one slidable closure element above a ground level; a weeping upright distal from said upright support forming a channel therebetween topping proximate said ground level; and an accumulator perpendicular to said channel and in fluid communication with said channel so that fluid received in said channel formed between said upright support and weeping upright flows to said accumulator.

In accordance with another embodiment of the present invention, an assembly is disclosed. The assembly comprises, in combination: an upright support allowing translational movement of at least one slidable closure element above a ground level; a weeping upright distal from said upright support topping proximate said ground level; wherein said weeping upright is shaped so as to form, in cooperation with said upright support, an L-shaped channel therebetween; and a drainage opening within one of said upright support, weeping upright, and L-shaped channel for removing said liquid within said channel.

In accordance with a further embodiment of the present invention, a system is disclosed. The system comprises, in combination: a slidable closure element; an upright support allowing translational movement of said slidable closure element above a ground level; a weeping upright distal from said upright support topping proximate said ground level; wherein said weeping upright is shaped so as to form, in cooperation with said upright support, an L-shaped channel therebetween; and a drainage opening within one of said upright support, weeping upright, and L-shaped channel for removing said liquid within said channel.

BRIEF DESCRIPTION OF DRAWINGS

The novel features believed to be characteristic of the application are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The application itself, however, as well as a preferred mode of use, further objectives and advantages thereof, will be best understood by reference to the following detailed description of illustrative embodiments when read in conjunction with the accompanying drawings, wherein:

DETAILED DESCRIPTION OF THE PREFERRED EMBODIMENTS

The foregoing description is provided to enable any person skilled in the relevant art to practice the various embodiments described herein. Various modifications to these embodiments will be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

Turning now to the drawings, FIGS. 1-7 show an exemplary window or door frame system 100 having an accumulator 102 for collecting and removing liquid on a side portion in accordance with one aspect of the present application. For sliding door assemblies, the system 100 can be positioned in the ground such that barriers from preventing ingress or egress are reduced or completely removed. As will be shown below, the accumulator 102 reduces the excavation process for installing the system 100 and allows for quicker setup times as well. While primarily intended for use with doors and windows, the system 100 can also accommodate other types of slidable paneling.

Figure 1:
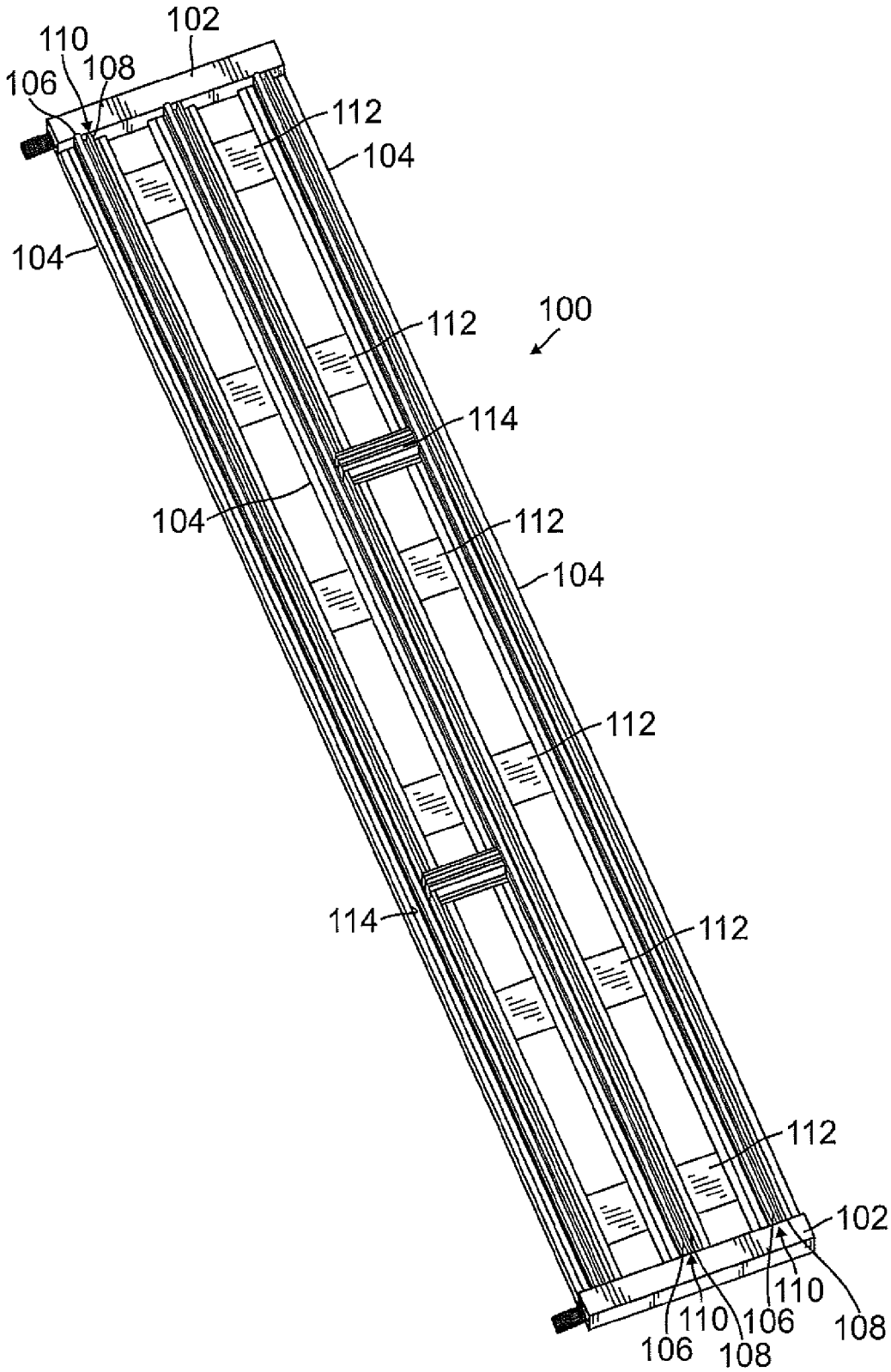
FIG. 1 is a top view of an exemplary window or door frame system that empties liquid into an accumulator in accordance with one aspect of the present application.

As depicted in FIG. 1, the system 100 can include at least one support member 104. The support member 104 can provide a sturdy bottom for other components of the system 100. While the support member 104 can be considered as a separate component, it should also be noted that the components described herein can be one continuous element. Attached thereto, mounting elements 112 can be used to provide additional support for the entire system 100.

Figure 2:
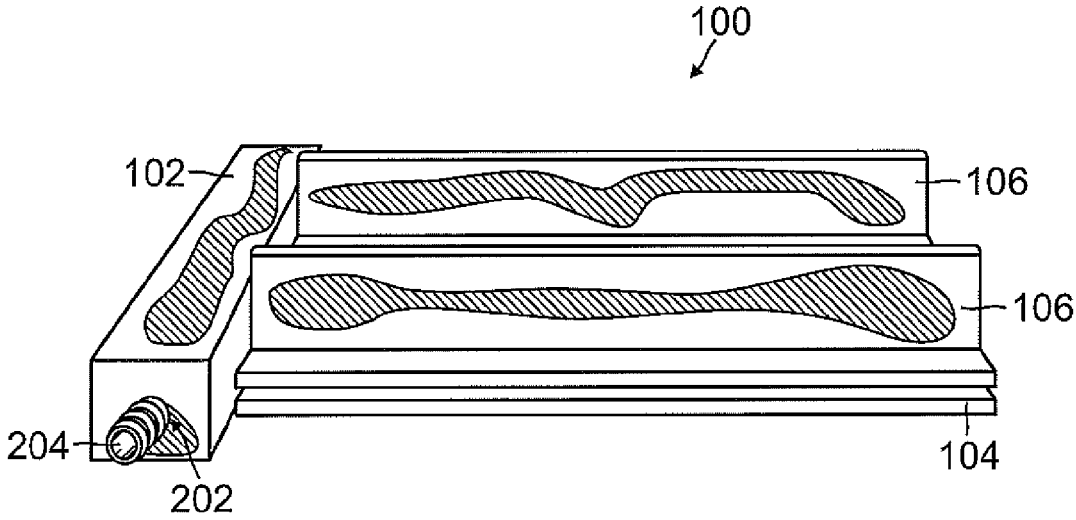
FIG. 2 is an elevated front cross sectional view thereof.

Coupled to the support member 104 can be an upright support 106 and a weeping upright 108. As shown, the upright support 106 and the weeping upright 108 may be parallel to each other. In one embodiment, the upright support 106 can be an elongated track extending upright from the support member 104. As shown in FIG. 2, the upright support 106 can extend past the accumulator 102 positioned over a floor or window sill. The upright support 106 can form a slight barrier to prevent liquid from the exterior area entering into the interior area.

Continuing with FIG. 1, a weeping channel 108 can be provided for each of the upright supports 106. As shown, the weeping channel 108 is parallel to the upright support 106 and spaced slightly apart. The weeping channel 108 can capture liquid either dripping or running off the panels or running across the floor surface and over the top of track from the exterior area toward the interior area. For windows, the weeping channel 108 captures liquid that can come over the sill.

Figure 16:
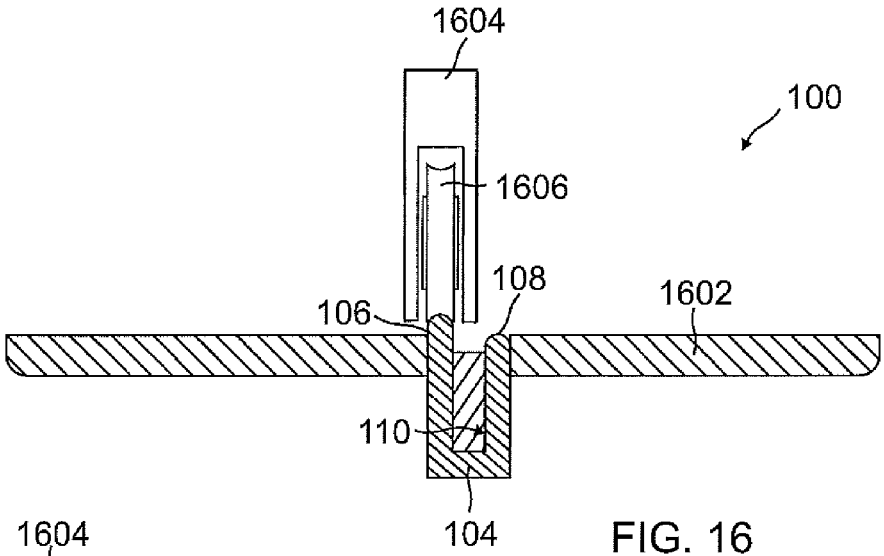
FIG. 16 is a cross sectional view of an exemplary window or door frame system depicting sliding panels in accordance with one aspect of the present application.

Depicted in FIG. 16, the upright support 106 can be positioned such that a lip extends past the floor or window sill 1602. The lip can prevent liquid from entering into the residence or interior. The weeping channel 108 can end at the floor or window sill 1602 or slightly below there. Through this combination, minimal barriers are imposed while still allowing the ability to collect liquid that enters within.

The upright support 106 can engage slidable panels 1604. The panels 1604 can include windows, doors, etc. In one embodiment, the panels 1604 can incorporate wheels 1606 which can engage with the upright support 106. In one embodiment, the upright support 106 can include a shaped top surface for smooth engagement with the wheels 1606 of the slidable panels 1604. Those skilled in the relevant art will appreciate that other configurations for slidable panels 1604 exist such as nearly frictionless surfaces, ball bearings, etc. While the slidable panels 1604 as shown are straight, the slidable panels 1604 can contain curves and the system 100 can be modified for the curved slidable panels 1604.

Figure 17:
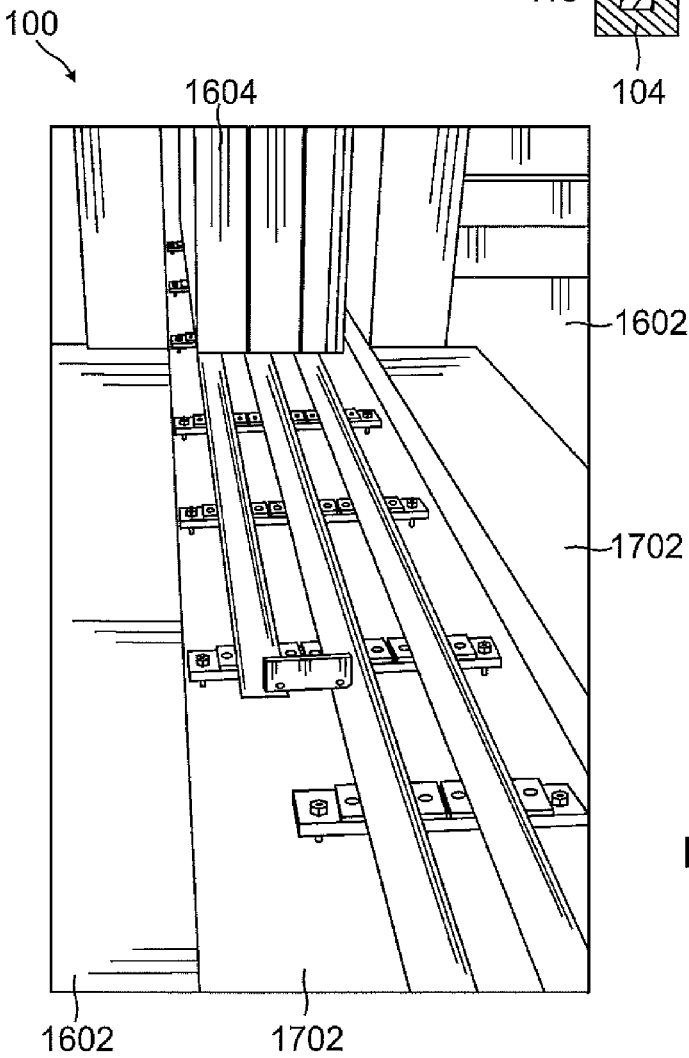
FIG. 17 is a top perspective unfinished view thereof.

FIG. 17 is a top perspective unfinished view of the window or door frame system 100. As shown, installation of the system 100 typically uses minimal trenching work. The unfinished floor 1702, in one embodiment, can provide a proper surface for placing the system 100. The panels 1604 of the system 100 described above can be in a closed or opened position. In the open position, the panels 1604 are placed into the side as shown. The panels 1604 can be extended therefrom into a closed position along the upper supports 106.

Figure 18:
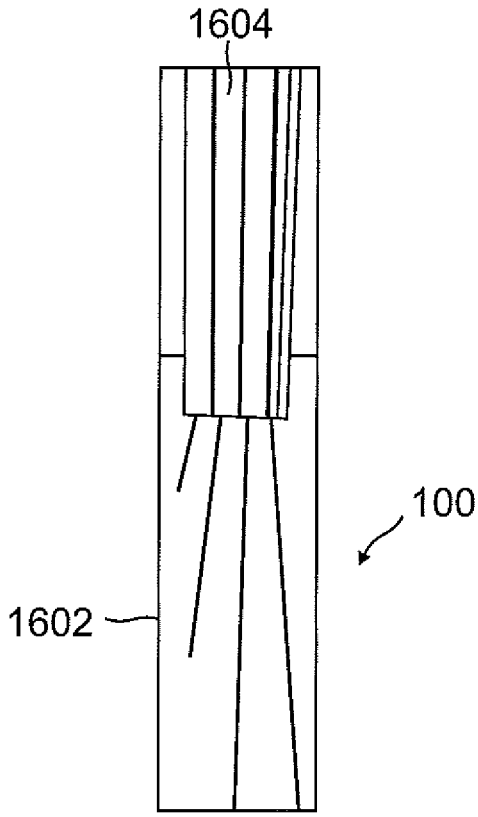
FIG. 18 is a top perspective finished view thereof.

FIG. 18 is a top perspective finished view of the window or door frame system 100. The flooring 1602 can be placed within the system 100 such that the upright supports 106 are minimally exposed while the weeping channel 108 is at or below the finished flooring 1602 as shown.

Returning to FIG. 1, the upright support 106 and the weeping upright 108 can form a channel 110 therebetween. The channel 110 can lie on top of the support member 104. In one embodiment, the channel 110 can be part of the support member 104. Alignment fasteners 114 can be coupled between each of the upright supports 106 and weeping uprights 108. The alignment fasteners 114 can provide lateral support to the system 100.

Figure 3:
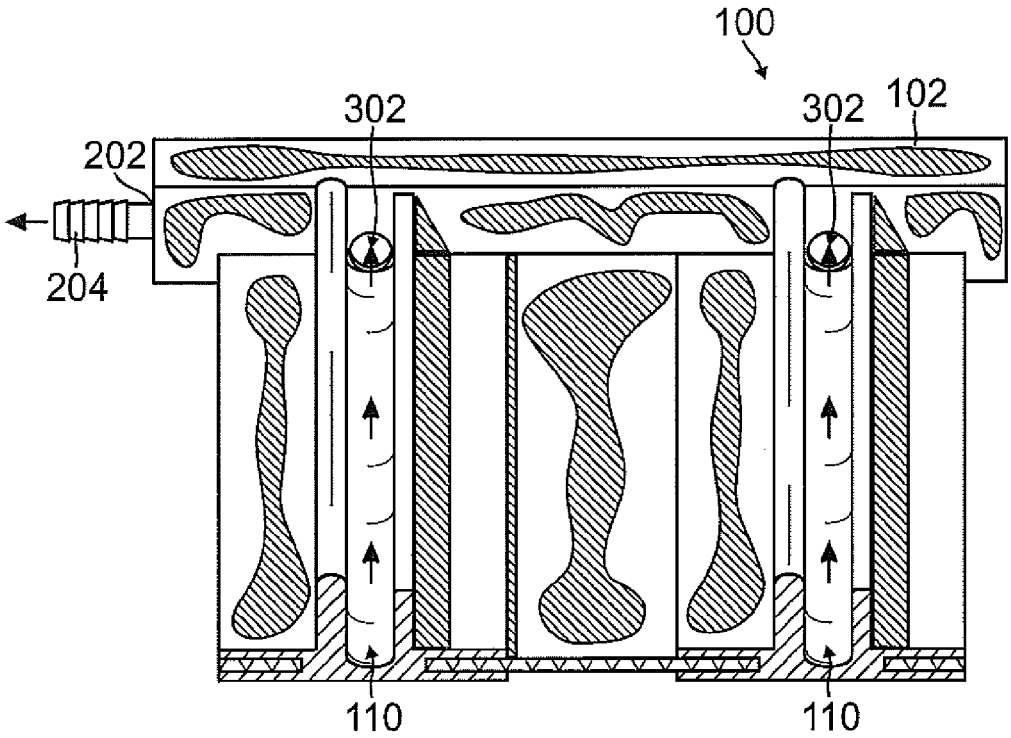
FIG. 3 is a top cross sectional view thereof.

As further shown in FIG. 3, the channel 110 can be used to remove liquid or other types of accumulated moisture from the system 100. An inlet 302 feeding into an accumulator 102 can be at the end of the channel 110. In the shown embodiment, the inlet 302 can be circular. In one embodiment, the inlet 302 can be provided in other shapes like a square. The inlet 302 can also conform to the shape of the channel 110.

A filter (not shown) can be used so that larger debris does not enter into the channel 110. In one embodiment, the filter can be a grate. The grate can allow liquid to flow through while preventing other fragments from entering. In one embodiment, the channel 110 can allow the debris to flow therethrough. The inlet 302 can be large enough to allow large debris to flow into the accumulator 102 where it can be later collected or passed through the accumulator 102 altogether.

As previously discussed, the channel 110 provides a flow of liquid into the accumulator 102 through the inlet 302. In one embodiment, the channel 110 can be sloped so that the liquid is directed into the inlet 302. The slope allows gravity to funnel the liquid through. When multiple accumulators 102 are used, as shown in FIG. 1, the channel 110 can be slopped midway directing liquid to each end.

Generally, the accumulator 102 is covered to prevent injuries. In one embodiment, the covering for the accumulator 102 can be opened such that debris or other materials can be removed. The accumulator 102 can be perpendicular to the channels 110. After the liquid is received from the channel 110 and into the accumulator 102, the accumulator can divert the liquid to an outlet 202. In one embodiment, the accumulator 102 can be sloped so that gravity forces the liquid to the outlet 202.

Figure 4:
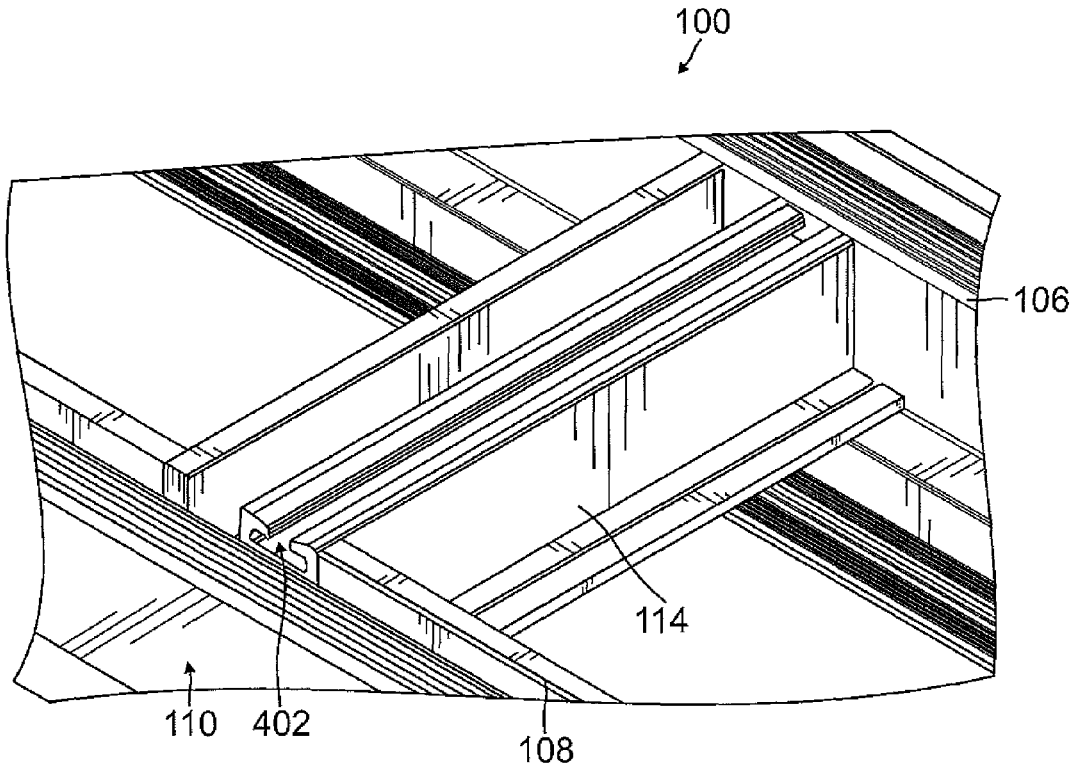
FIG. 4 is a top perspective view of a cross section thereof.

FIG. 4 is a top perspective view of a cross section of the exemplary window or door frame system 100. The alignment fasteners 114 can be coupled to the upright support 106 and weeping upright 108. The alignment fasteners 114 can be coupled such that any fluid therein can be distributed within the channel 110 through a drainage canal 402. Typically, the canal 402 is sloped so that liquid empties into the channel 110. With the alignment fasteners 114, a stronger frame system 100 can be provided.

Figure 5:
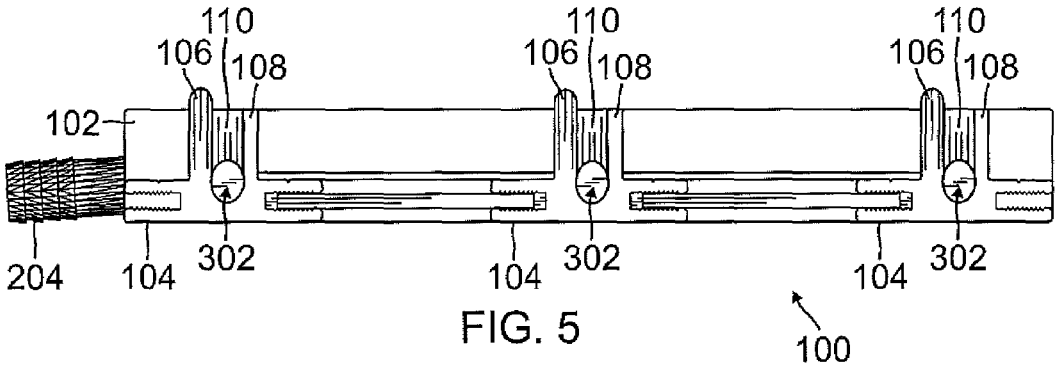
FIG. 5 is a side view thereof.

FIG. 5 is a side view of the exemplary window or door frame system 100. While three support members 104 are shown, one skilled in the relevant art will appreciate that fewer or more support members 104 can be interconnected together. Each of the support members 104 can include an upright support 106 and a weeping upright 108 with a channel 110 therebetween that feeds into the accumulator 102. The cross sectional view shows the inlet 302 feeding into the accumulator 102 with the accumulator 102 funneling the liquid into the nozzle 204. The nozzle 204 can be bent at an angle so that the liquid continuously travels out using gravity.

Figure 9:
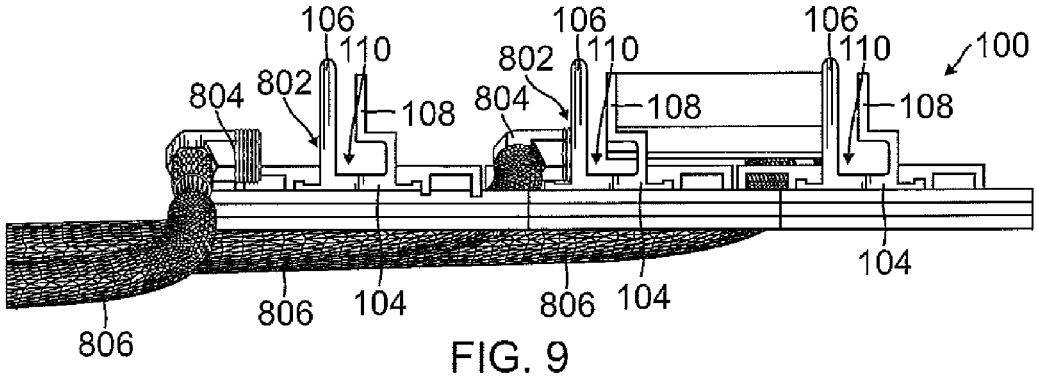
FIG. 9 is a side view thereof.

The weeping upright 108, which is not load-bearing, can take a variety of shapes and is not limited to the vertical structure shown in FIGS. 1-7. For example, and as shown in FIG. 9, the weeping upright 106 can be shaped so as to form, in cooperation with the upright support 106, an L-shaped channel 110, as best seen in FIGS. 8-10 and 12-14. This configuration converts channel 110 into a combination channel and accumulator, creating a drainage basin that runs the entire length of the system 100 as compared to prior designs wherein drainage is confined to a collection box mounted below the track and occupying only a small portion of the length of the track.

Figure 6:
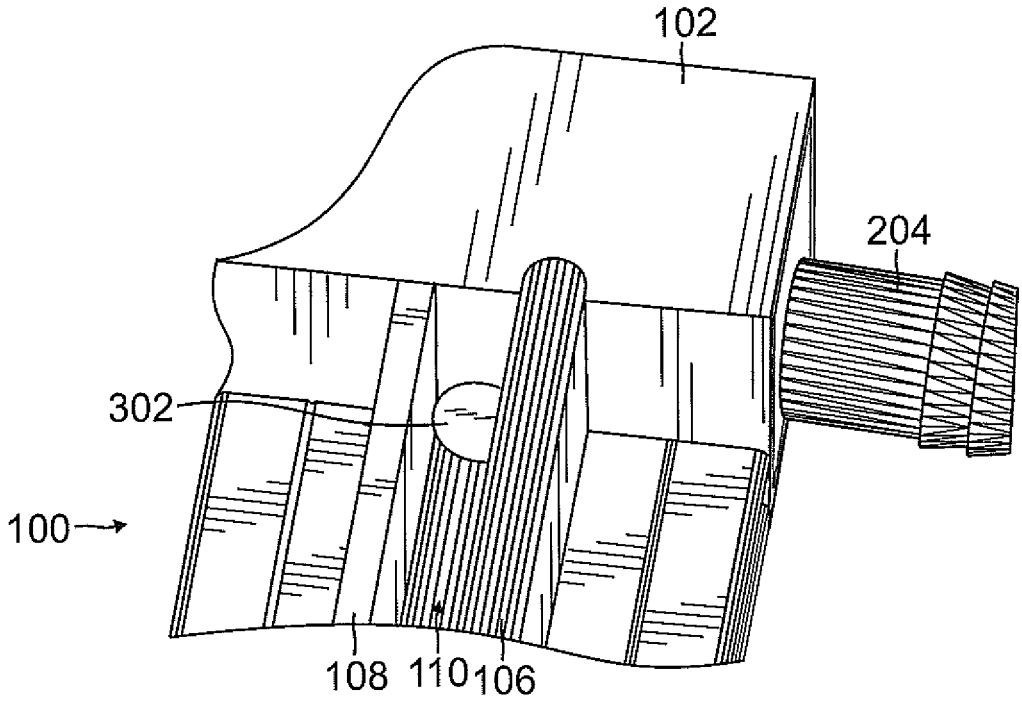
FIG. 6 is a magnified top view of the accumulator thereof.
Figure 7:
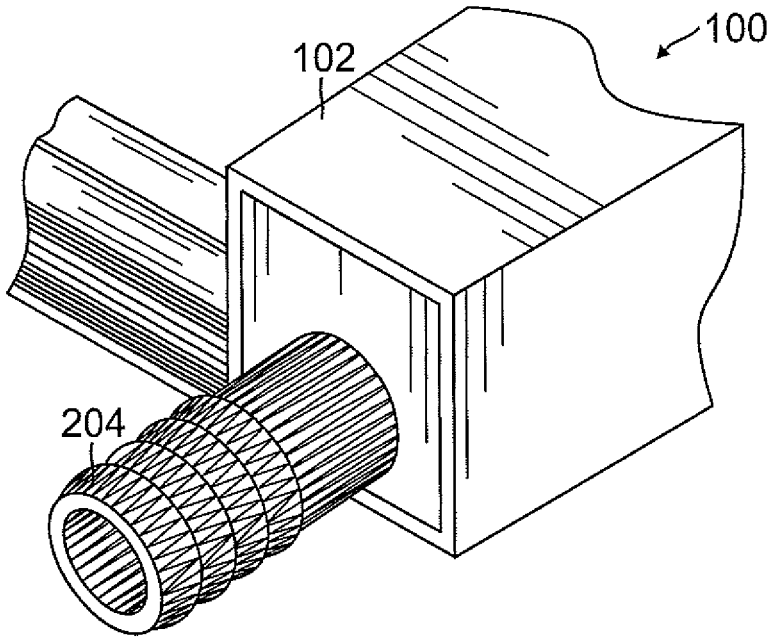
FIG. 7 is a magnified side perspective view thereof.
Figure 8:
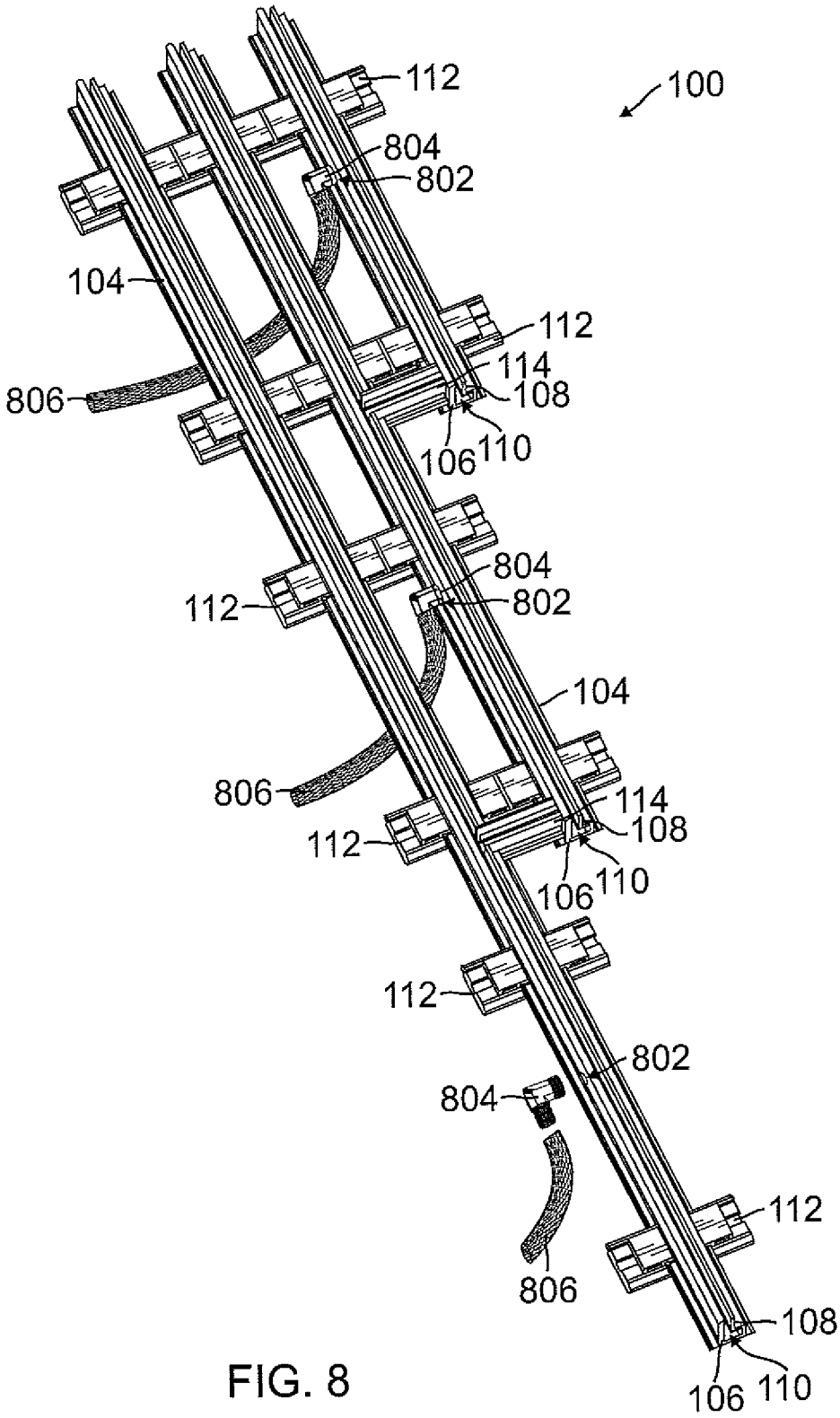
FIG. 8 is a top view of an illustrative window or door frame system having a conduit emptying from the side of its upright support in accordance with one aspect of the present application.

FIG. 6 is a magnified top view of the accumulator 102. As shown, the inlet 302 feeds liquid into the accumulator 102 through the channel 110. FIG. 7 is a magnified side perspective view of the accumulator 102. In one embodiment, a hose or other type of tubing can be connected to the nozzle 204.

FIGS. 1-7 provided numerous components for the system 100. Known to those skilled in the relevant art, fewer or more components can be incorporated into the system 100. In one embodiment, the system 100 can incorporate a check valve. The check valve can allow liquid to flow one-way, while preventing any liquid from coming the opposite way. The check valve can be placed within the accumulator 102. Alternatively, the check valve can be incorporated into the nozzle 204 or other extension thereof.

In one exemplary window or door frame system 100, liquid can be removed from the channel 110 from a side drainage opening 802 as depicted in FIGS. 8-11. Generally described and shown in FIG. 8, the upright support 106 and the weeping upright 108 can be held together through support members 104. The support members 104 can then be placed on mounting elements 112. Alignment fasteners 114 can also be used to provide lateral support for the system 100. Those skilled in the relevant art will appreciate that similar components can be present in each of the exemplary window or door frame systems 100.

The drainage opening 802 can be positioned within the upright support 106. Alternatively, the drainage opening 802 is provided in the weeping upright 108. Typically, the drainage opening 802 can positioned such that a portion of the drainage opening 802 is above a bottom of the channel 110 and another portion of the drainage opening 802 can be right at or slightly below the channel 110 as more clearly shown in FIG. 9. By positioning the drainage opening 802 in such a way, the maximum amount of liquid can be removed from the channel 110.

In one embodiment, the drainage opening 802 can be connected to an elbow joint 804. While the elbow joint 804 allows the flow of liquid away from the other components of the system 100, those skilled in the relevant art will appreciate that other types of connectors can be used and attached to the drainage opening 802. Typically, the elbow joint 804 and the drainage opening 802 can contain threading so that the elbow joint can be fitted securely removing the possibility of leaks.

Generally, a conduit 806 can be coupled to the elbow joint 804 to further carry the liquid from the channel 110 away from the system 100. The conduit 806 can take the form of a hose or other type of tubing. The channel 110 can be sloped such that the liquid therein is provided to the drainage opening 802. While numerous conduits 806 are shown, one centralized conduit 806 can be used to remove the liquid.

As noted above, the weeping upright 108 can be shaped so as to form, in cooperation with upright support 106, an L-shaped channel 110. angled such that more liquid can flow through the channel 110. This implementation of the weeping upright 108 can be used in the embodiments described herein. Optionally, the upright support 106 can be shaped, perhaps in similar manner, to expand the channel 110, either in cooperation with a vertical weeping upright 108 or a shaped weeping upright 108.

In one embodiment, the drainage opening 802 can be placed proximate the middle of the upright support 106 or the weeping upright 108. Alternatively, the drainage opening 802 can be placed on one side. The channel 110 may be sloped so that the liquid flows towards the drainage opening 802. While only one opening is shown in each of the upright supports 106 or weeping uprights 108, those skilled in the relevant art will appreciate that there can be two or more drainage openings 802 placed therein.

Figure 10:
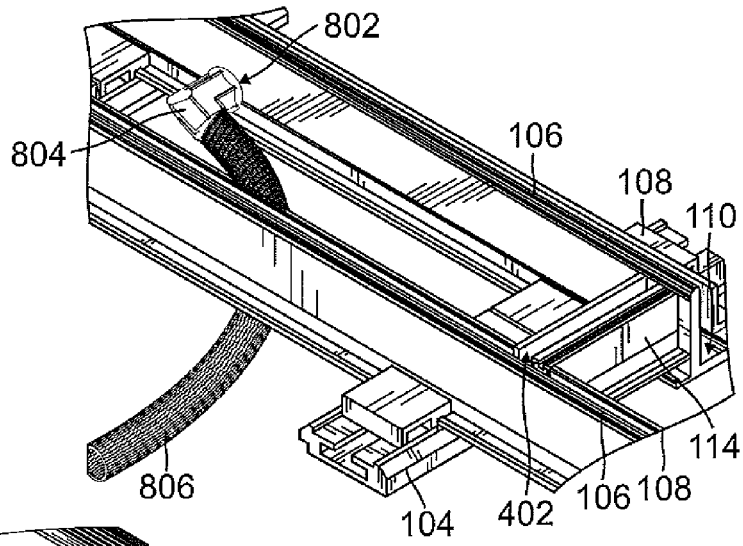
FIG. 10 is a top cross sectional view thereof.

FIG. 10 is a top cross sectional view of the exemplary window or door frame system 100. As shown, alignment fasteners 114 can provide lateral support for the system 100. One end of the alignment fastener 114 can connect to the upright support 106 while the other end can connect to the weeping upright 108. The alignment fastener 114 can contain a drainage canal 402 that empties into the channel 110.

Figure 11:
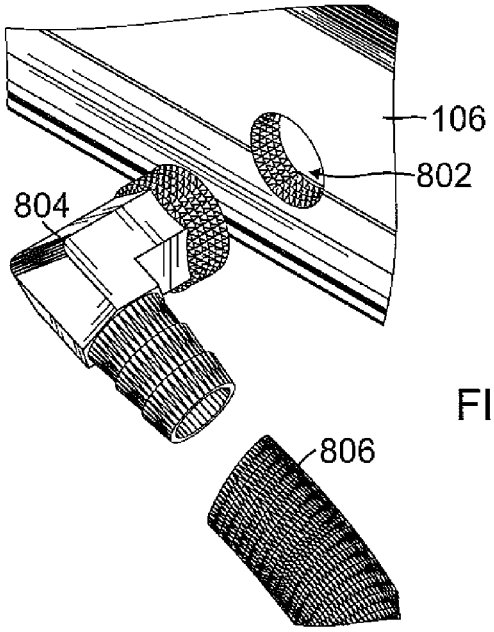
FIG. 11 is a magnified side view thereof.

FIG. 11 is a magnified side view of the exemplary window or door frame system 100. The magnified view shows the threading for the elbow joint 804 into the drainage opening 802 which is within the upright support 106. A conduit 806 can be coupled to the elbow joint 804. The conduit 806 and the elbow joint 804 can be connected through threading known to those skilled in the relevant art.

As provided above, FIGS. 16-18 depict the window or door panels 1604 that can be placed on the upright support 106. Those skilled in the relevant art will appreciate that the window or door panels 1604 can be implemented on the embodiment described above.

In one exemplary window or door frame system 100, liquid can be removed through a bottom portion as depicted in FIGS. 12-15. The upright support 106 and the weeping upright 108 can be held together through support members 104. The support members 104 can then be placed on mounting elements 112. Alignment fasteners 114 can also be placed for lateral support in the system 100. Those skilled in the relevant art will appreciate that similar components can be present in each of the exemplary window or door frame systems 100.

Figure 12:
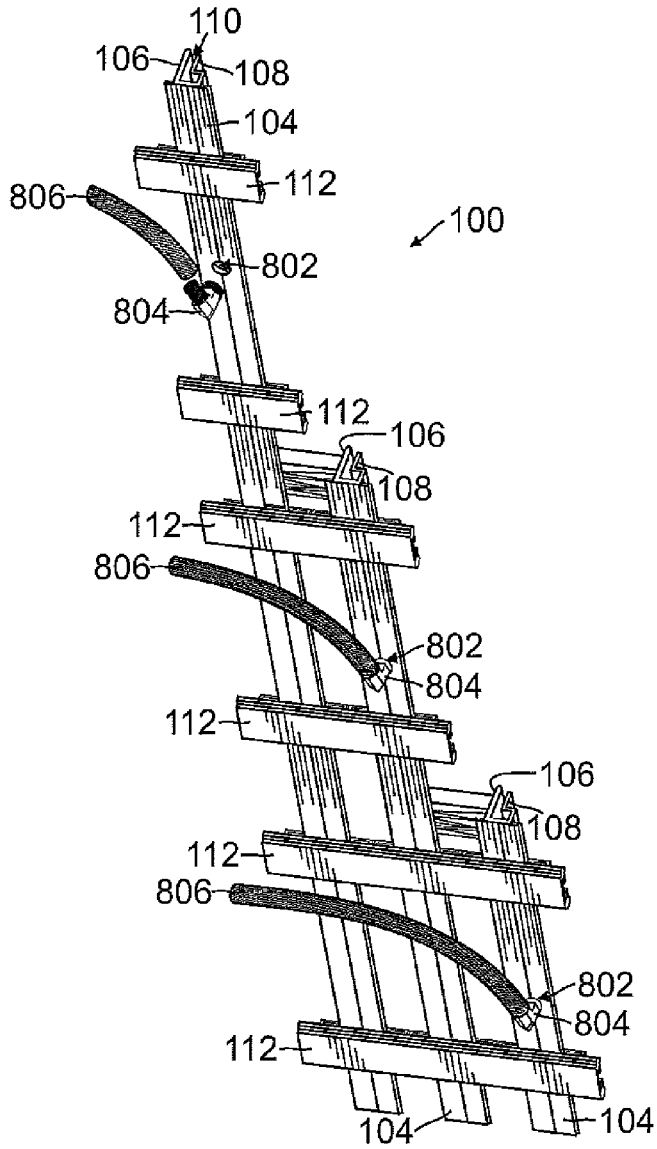
FIG. 12 is a bottom view of an exemplary window or door frame system that empties liquid a bottom portion in accordance with one aspect of the present application.

In the embodiment shown in FIG. 12, the drainage opening 802 opens into the bottom of the L-shaped channel 110 through the support member 104. While only one drainage opening 802 per support member 104 is shown, those skilled in the relevant art will appreciate that there can be two or more openings for each support member 104. In one embodiment, the channel 110 can be sloped such that liquid therein can be funneled downwards by gravity into the drainage opening 802.

Figure 13:
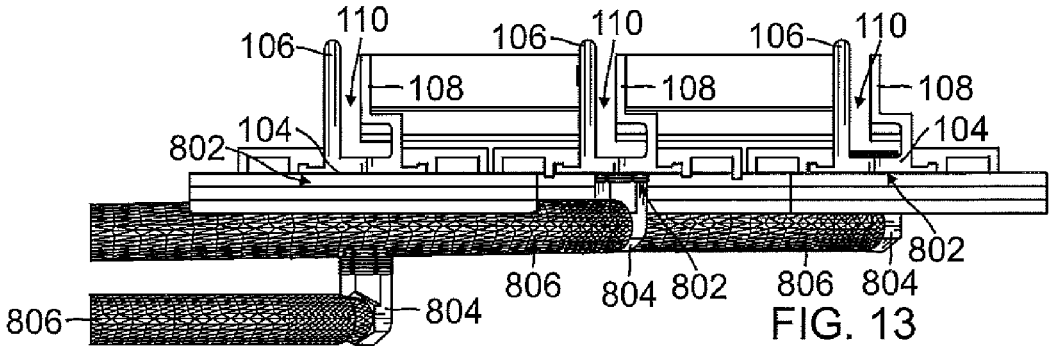
FIG. 13 is a side view thereof.

FIG. 13 is a side view of the exemplary window or door frame system 100. The drainage opening 802 can be coupled to an elbow joint 804. In one embodiment, a simple connector can be used instead of the elbow joint 804. The elbow joint 804 can then be connected to a conduit 806. FIG. 13 illustrates that more than one conduit 806 can be used. In other embodiments, a single conduit 806 can be connected to each of the elbow joints 804.

Figure 14:
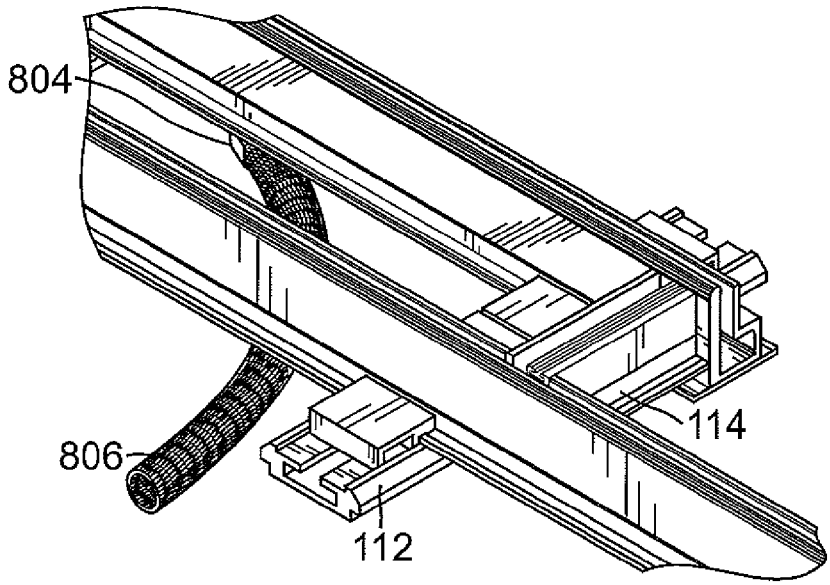
FIG. 14 is a closer top perspective view thereof.
Figure 15:
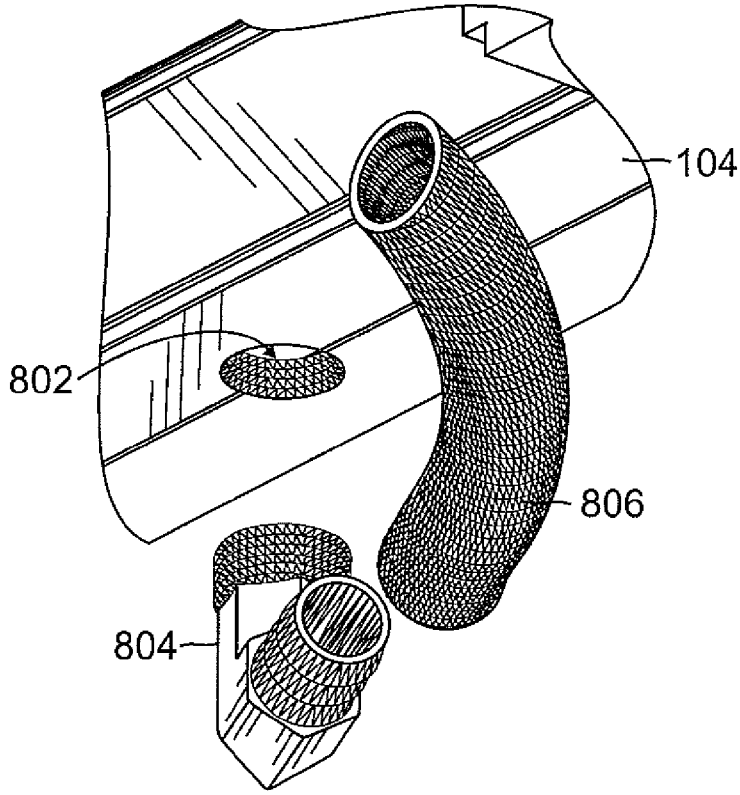
FIG. 15 is an expanded view thereof.

FIG. 14 is a closer top perspective view of the exemplary window or door frame system 100. The upright support 106, weeping upright 108, and channel 110 therebetween can be coupled through an alignment faster 114 that provides additional support for the system 100. FIG. 15 is an expanded view of the exemplary window or door frame system 100. The threading used by the elbow joint 804 can be fitted securely into the drainage opening 802 so that leaks are prevented. The conduit 806 can be coupled thereto.

As provided above, FIGS. 16-18 depict the window or door panels 1604 that can be placed on the upright support 106. Those skilled in the relevant art will appreciate that the window or door panels 1604 can be implemented on the embodiment described above.

The foregoing description is provided to enable any person skilled in the relevant art to practice the various embodiments described herein. Various modifications to these embodiments will be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. An assembly comprising:

an upright support allowing translational movement of at least one slidable closure element on top of said upright support;

a weeping upright distal from said upright support forming a channel therebetween topping proximate said ground level;

an accumulator perpendicular to said channel and in fluid communication with said channel so that fluid received in said channel formed between said upright support and weeping upright flows to said accumulator; and an alignment fastener connected to the upright support and the weeping upright to provide support thereto, a drainage channel formed within the alignment fastener and in fluid communication with said channel formed between said upright support and the weeping upright.

2. The assembly of claim 1, further comprising at least one slidable closure element positioned above said upright support.

3. The assembly of claim 1, wherein said channel slopes to direct said fluid to said accumulator.

4. The assembly of claim 1, wherein said accumulator comprises an inlet for receiving fluid from said channel.

5. The assembly of claim 1, wherein said accumulator comprises an outlet for disposing said fluid.

6. The assembly of claim 5, wherein said outlet is coupled to a nozzle.

7. The assembly of claim 6, wherein said nozzle is fitted with a hose to dispose said fluid.

8. The assembly of claim 5, wherein said accumulator is sloped in a direction of said outlet.

9. An assembly comprising:

an upright support allowing translational movement of at least one slidable closure element above a ground level on top of said upright support;

a weeping upright distal from said upright support topping proximate said ground level;

wherein said weeping upright is shaped so as to form, in cooperation with said upright support, an L-shaped channel therebetween;

a drainage opening within one of said upright support, weeping upright, and L-shaped channel for removing said liquid within said channel; and an alignment fastener connected to the upright support and the weeping upright to provide support thereto, a drainage channel formed within the alignment fastener and in fluid communication with said channel formed between said upright support and the weeping upright.

10. The assembly of claim 9, further comprising an elbow joint coupled to said drainage opening.

11. The assembly of claim 10, further comprising a conduit connected to said elbow joint.

12. The assembly of claim 9, wherein said drainage opening is positioned proximate a middle of said channel or weeping upright.

13. The assembly of claim 9, wherein said channel is sloped such that said liquid flows to said drainage opening.

14. A system comprising:

a slidable closure element;

an upright support allowing translational movement of said slidable closure element above a ground level on top of said upright support;

a weeping upright distal from said upright support topping proximate said ground level;

wherein said weeping upright is shaped so as to form, in cooperation with said upright support, an L-shaped channel therebetween;

a drainage opening within one of said upright support, weeping upright, and L-shaped channel for removing liquid within said channel; and an alignment fastener connected to the upright support and the weeping upright to provide support thereto, a drainage channel formed within the alignment fastener and in fluid communication with said channel formed between said upright support and the weeping upright.

15. The system of claim 14, further comprising an elbow joint coupled to said drainage opening.

16. The system of claim 15, further comprising a conduit connected to said elbow joint.

17. The system of claim 14, wherein said drainage opening is positioned proximate a middle section of said channel or weeping upright.

18. The system of claim 14, wherein said channel is sloped such that said liquid flows to said drainage opening.

* * * * *